US010803882B2

(12) United States Patent
Shim et al.

(10) Patent No.: US 10,803,882 B2
(45) Date of Patent: Oct. 13, 2020

(54) APPARATUS AND METHOD OF SEPARATING SOUND SOURCES

(71) Applicant: KOREA INSTITUTE OF SCIENCE AND TECHNOLOGY, Seoul (KR)

(72) Inventors: Jae Wan Shim, Seoul (KR); Heon Phil Ha, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 16/546,440

(22) Filed: Aug. 21, 2019

(65) Prior Publication Data

US 2020/0152216 A1 May 14, 2020

(30) Foreign Application Priority Data

Nov. 12, 2018 (KR) ..... 10-2018-0138304

(51) Int. Cl.

| | |
|---|---|
| ***G10L 21/028*** | (2013.01) |
| ***G10L 25/30*** | (2013.01) |
| ***H04R 1/34*** | (2006.01) |
| ***H04R 1/40*** | (2006.01) |
| ***H04R 3/00*** | (2006.01) |

(52) U.S. Cl.

CPC ..... *G10L 21/028* (2013.01); *G10L 25/30* (2013.01); *H04R 1/342* (2013.01); *H04R 1/406* (2013.01); *H04R 3/005* (2013.01)

(58) Field of Classification Search

CPC ..... G10L 21/028; G10L 25/30; H04R 1/40; H04R 1/34; H04R 3/00

USPC ..... 381/92; 700/245, 246

See application file for complete search history.

(56) References Cited

U.S. PATENT DOCUMENTS

| | | | | |
|---|---|---|---|---|
| 8,229,129 | B2 | 7/2012 | Jeong et al. | |
| 9,907,509 | B2 | 3/2018 | Bae et al. | |
| 10,402,625 | B2 | 9/2019 | Sung et al. | |
| 2002/0181723 | A1* | 12/2002 | Kataoka | B25J 13/003 381/92 |
| 2003/0139851 | A1* | 7/2003 | Nakadai | G10L 21/0208 700/258 |
| 2016/0052140 | A1* | 2/2016 | Li | B25J 5/00 455/420 |
| 2017/0025199 | A1 | 1/2017 | Song et al. | |
| 2017/0353789 | A1* | 12/2017 | Kim | H04R 3/005 |
| 2018/0286432 | A1* | 10/2018 | Shimada | G10L 25/78 |

(Continued)

FOREIGN PATENT DOCUMENTS

| | | | |
|---|---|---|---|
| JP | 2007-318373 | A | 12/2007 |
| KR | 10-0822880 | B1 | 4/2008 |

(Continued)

*Primary Examiner* — Melur Ramakrishnaiah

(74) *Attorney, Agent, or Firm* — Rabin & Berdo, P.C.

(57) ABSTRACT

A sound source separating apparatus may include: a housing; a plurality of microphones positioned on the housing; a plurality of sound guides positioned on the housing to be adjacent to the plurality of microphones, and configured to guide sound to the plurality of microphones and to generate a difference between a plurality of sound information respectively arriving at the plurality of microphones according to a direction of a sound source; and a processor configured to separate the sound source according to the direction of the sound source based on the plurality of sound information received by the plurality of microphones.

19 Claims, 19 Drawing Sheets

(56) References Cited

U.S. PATENT DOCUMENTS

| | | | | |
|---|---|---|---|---|
| 2019/0104357 | A1* | 4/2019 | Atkins | G06N 3/08 |
| 2019/0115043 | A1* | 4/2019 | Ikeshita | G10L 21/0308 |

FOREIGN PATENT DOCUMENTS

| | | | |
|---|---|---|---|
| KR | 10-2009-0037845 | A | 4/2009 |
| KR | 10-1217254 | B1 | 12/2012 |
| KR | 10-2015-0113379 | A | 10/2015 |
| KR | 10-2017-0011905 | A | 2/2017 |
| KR | 10-2017-0096083 | A | 8/2017 |
| KR | 10-2017-0110919 | A | 10/2017 |

* cited by examiner

APPARATUS AND METHOD OF SEPARATING SOUND SOURCES

CROSS-REFERENCE TO RELATED APPLICATION

This application claims the benefit of Korean Patent Application No. 10-2018-0138304, filed on Nov. 12, 2018, in the Korean Intellectual Property Office, the disclosure of which is incorporated herein in its entirety by reference.

BACKGROUND

1. Field

One or more embodiments relate to an apparatus for separating sound sources.

2. Description of the Related Art

Due to the development of electronic technology, various types of user terminals are being developed and come into wide use. Recently, as the sizes of user terminals are reduced, the functions became more diverse. Accordingly, user terminals are in increasing demand.

User terminals provide various contents, such as multimedia content or an application screen, according to a user's request. A user uses a user interface, such as a button or a touch screen, included in a user terminal, to select a function which he/she wants to use.

Owing to the development of voice recognition technology, many user terminals include a microphone as a user interface to execute a program selectively according to a user's voice. For voice recognition through a microphone, a technique for separating a user's sound source from surrounding sound sources is required.

Sound source separation is to separate one or more sound signals before mixing from mixed sound signals. Studies into blind signal separation, particularly, independent component analysis technology have been conducted from the early 1990s. Various methods, such as azimuth estimation, independent component analysis (ICA), nonnegative matrix factorization (NMF), feature point extraction, etc., have been used, and recently, due to the development of deep learning, sound source separating methods using a neural network are being proposed.

SUMMARY

One or more embodiments include a sound source separating apparatus for distinguishing a meaningful voice from noise, because an increase of noise lowers accuracy consistently.

One or more embodiments include a sound source separating apparatus for detecting a generation point of each sound constituting a mixed sound.

One or more embodiments include a sound source separating apparatus for distinguishing a desired sound, as well as a voice, from the other sound.

One or more embodiments include a sound source separating apparatus having a sound-based user interface with an improved user environment.

Additional aspects will be set forth in part in the description which follows and, in part, will be apparent from the description, or may be learned by practice of the presented embodiments.

According to one or more embodiments, a sound source separating apparatus includes: a housing; a plurality of microphones positioned on the housing; a plurality of sound guides positioned on the housing to be adjacent to the plurality of microphones, and configured to guide a sound to the plurality of microphones and to generate a difference between a plurality of sound information respectively arriving at the plurality of microphones according to a direction of a sound source; and a processor configured to separate the sound source according to the direction of the sound source based on the plurality of sound information received by the plurality of microphones.

The housing may include a body and a head positioned on the body, the plurality of microphones may include a first microphone and a second microphone positioned at both sides of the head, and the plurality of sound guides may include a first sound guide and a second sound guide respectively protruding from the head at locations adjacent to the first microphone and the second microphone, the first sound guide and the second sound guide having a predetermined shape.

The first sound guide and the second sound guide may have a deformable structure or be movably coupled with the head, and the sound source separating apparatus may further include a sound guide driver configured to move the first sound guide and the second sound guide in response to sound source separation by the processor.

The head may be coupled with the body in such a way to be movable with respect to the body, and the sound source separating apparatus may further include a head driver installed in at least one of the body or the head, and configured to move the head.

When probabilistic certainty for the result of the sound source separation by the processor does not reach a predetermined reference value upon separation of the sound source according to the direction of the sound source, the processor may move at least one of the first sound guide and the second sound guide or the head to increase raw data required for the processor to separate the sound source according to the direction of the sound source.

When the processor separates an already learned speaker's voice upon separation of the sound source according to the direction of the sound source, the processor may move at least one of the first sound guide and the second sound guide or the head towards the speaker.

When the processor separates a plurality of already learned speakers' voices upon separation of the sound source according to the direction of the sound source, the processor may move at least one of the first sound guide and the second sound guide or the head towards the speakers in order according to a predetermined rating method.

When the processor fails to understand content of the sound source, the processor may move at least one of the first sound guide and the second sound guide or the head.

The first sound guide and the second sound guide may be in the shape of bio-mimetic rabbit ears.

According to one or more embodiments, a sound source separating apparatus includes: a body; a head positioned on the body, and coupled with the body in such a way to be movable with respect to the body; a first microphone and a second microphone respectively positioned at both sides of the head; a first sound guide and a second sound guide protruding from the head at locations adjacent to the first microphone and the second microphone, and configured to guide a sound to the first microphone and the second microphone and to generate a difference between a plurality of sound information respectively arriving at the first microphone and the second microphone according to a direction of a sound source, the first sound guide and the second sound guide having a predetermined shape; a processor configured to separate the sound source according to a direction of the sound source based on the plurality of sound information received by the first microphone and the second microphone; and a head driver configured to move the head in response to sound source separation by the processor.

The processor may include: a Fourier transformer configured to perform Fourier transform on each of the plurality of sound information; a partitioner configured to partition the plurality of Fourier-transformed sound information at predetermined intervals in at least one of a time domain or a frequency domain; and a neural network formed based on the plurality of partitioned sound information, wherein the processor separates the direction of the sound source from the plurality of sound information based on output information output from the neural network.

The partitioner may partition each of the plurality of Fourier-transformed sound information, and the plurality of partitioned sound information may be input to the neural network.

The sound source separating apparatus may further include a difference signal generator configured to generate a difference signal from at least one pair configured with the plurality of Fourier-transformed sound information, wherein the partitioner may partition the difference signal, and the partitioned difference signal may be input to the neural network.

The partitioner may partition the plurality of Fourier-transformed sound information at predetermined time intervals in a time domain, the neural network may receive the plurality of partitioned sound information in the time domain to output a first output value, the partitioner may partition the plurality of Fourier-transformed sound information at predetermined frequency intervals in a frequency domain, the neural network may receive the plurality of partitioned sound information in the frequency domain to output a second output value, and the neural network may separate the sound source by using an intersection of the first output value and the second output value.

The partitioner may partition the plurality of Fourier-transformed sound information at predetermined time intervals in a time domain and at predetermined frequency intervals in a frequency domain, and the neural network may receive the plurality of sound information partitioned in the time domain and the frequency domain.

The partitioned information of the plurality of sound information may overlap with a predetermined interval in at least one of the time domain or the frequency domain.

The neural network may be a convolutional neural network, a Boltzmann machine, a restricted Boltzmann machine, or a deep belief neural network.

The sound source separating apparatus may further include at least one of a speaker or a display.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Hereinafter, various embodiments of the disclosure will be described in detail with reference to the accompanying drawings.

Figure 1:
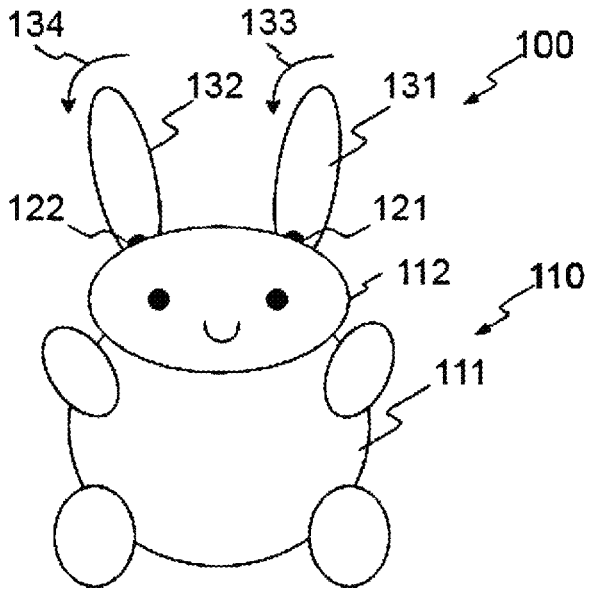
FIG. 1 schematically shows an outer appearance of a sound source separating apparatus according to an embodiment of the disclosure.
Figure 2:
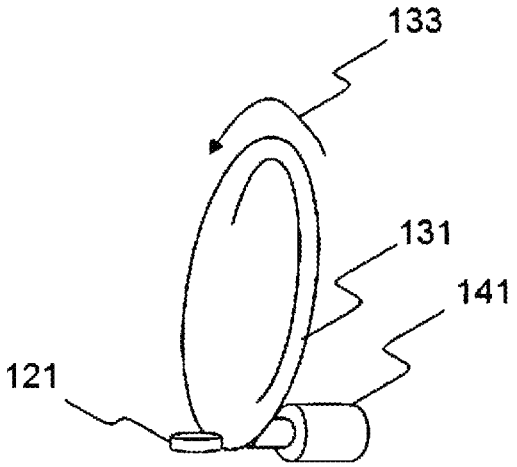
FIG. 2 schematically shows a driving structure of a first sound guide of the sound source separating apparatus of FIG. 1.

FIG. 1 schematically shows an outer appearance of a sound source separating apparatus according to an embodiment of the disclosure, and FIG. 2 schematically shows a driving structure of a first sound guide of the sound source separating apparatus of FIG. 1.

Referring to FIGS. 1 and 2, a sound source separating apparatus 100 may include a housing 110, first and second microphones 121 and 122, and first and second sound guides 131 and 132.

In the inside of the housing 110, a circuit portion (200 of FIG. 4) may be provided to control all operations of the sound source separating apparatus 100.

The housing 110 may include a body 111 and a head 112 positioned on the body 111, and the first and second microphones 121 and 122 may be positioned at both sides of the head 112.

The first and second sound guides 131 and 132 may protrude from the head 112 at locations adjacent to the first and second microphones 121 and 122, and may be movably coupled with the head 112 (movements 133 and 134).

Figure 3:
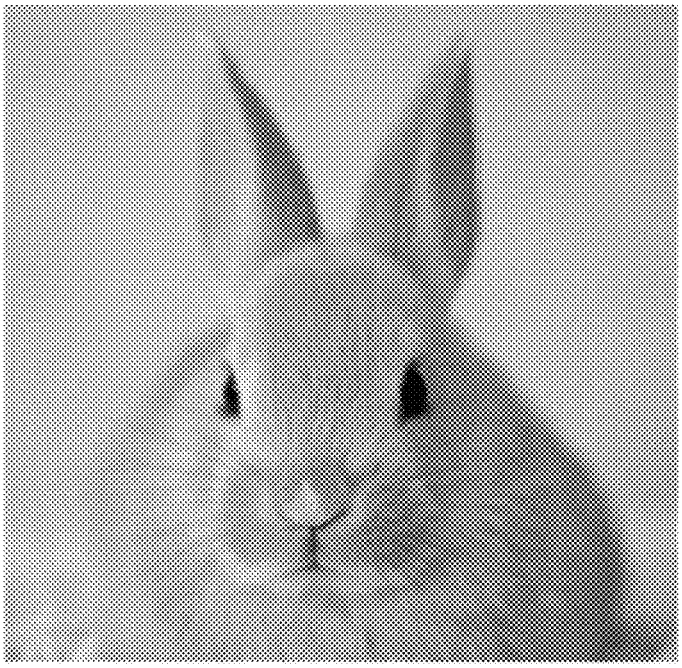
FIG. 3 shows a detailed shape of a bio-mimetic rabbit configured with a housing and a sound guide of the sound source separating apparatus of FIG. 1.

The first and second sound guides 131 and 132 may perform a function of causing sound signals input to the first and second microphones 121 and 122 to have different acoustic properties according to a direction of the corresponding sound source. For example, the first and second sound guides 131 and 132 may be in the shape of biomimetic rabbit ears, as shown in FIG. 3. That is, each of the first and second sound guides 131 and 132 may have a long shape, and guide a sound transferred from the front and side portions to the first and second microphones 121 and 122. Due to the positions of the first and second sound guides 131 and 132, properties of a sound received from a sound source located in front of or beside the sound source separating apparatus 100 may become different from those of the sound received from the sound source located behind the sound source separating apparatus 100. The first and second sound guides 131 and 132 may be in the shape of rabbit ears, although not limited thereto. As another example, the first and second sound guides 131 and 132 may be in the shape of a flat plate or a concavely curved plate.

In the inside of the head 112, a first sound guide driving motor 141 may be installed to actively move the first sound guide 131. Also, a second sound guide driving motor (not shown) may be installed in the inside of the head 112 to actively move the second sound guide 132.

For example, the first and second sound guides 131 and 132 may move to increase raw data required for sound source separation. When the process (210 of FIG. 4) separates sound sources according to their directions, probabilistic certainty for the result of the separation may not reach a predetermined reference value, as described later. In this case, the first and second sound guides 131 and 132 may move to increase raw data required for the processor 310 to separate the sound sources. Directions of movements 133 and 134 of the first and second sound guides 131 and 132 may be decided randomly or as a direction of a sound source having highest probability in the result of sound source separation.

According to another example, when an already learned speaker's voice is separated upon sound source separation, the sound source separating apparatus 100 may move the first and second sound guides 131 and 132 towards the speaker (sound source) to imitate an interaction with the speaker.

According to still another example, when the processor 210 separates a plurality of already learned speakers' voices upon separation of sound sources according to their directions, the sound source separating apparatus 100 may move the first and second sound guides 131 and 132 towards the speakers (sound sources) according to a predetermined rating method. When the sound source separating apparatus 100 or an electronic apparatus communicating with the sound source separating apparatus 100 operates according to a speaker's voice command, the sound source separating apparatus 100 or the electronic apparatus may analyze a plurality of rated speakers' voice commands in order to determine whether a meaningful voice command is received, and move the first and second sound guides 131 and 132 towards a speaker with a top priority among speakers who have issued meaningful voice commands.

According to another example, in the case that the sound source separating apparatus 100 or the electronic apparatus communicating with the sound source separating apparatus 100 fails to understand content of a sound source when the processor 210 separates the sound source according to its direction, the sound source separating apparatus 100 may move the first and second sound guides 131 and 132 to imitate a gesture or body language representing that the sound source separating apparatus 100 cannot understand what the sound source means.

According to another example, the movements 133 and 134 of the first and second sound guides 131 and 132 may be a motion of standing upward to imitate a rabbit's gesture of pricking up its ears when a sound is input to the first and second microphones 121 and 122.

According to another example, when the processor 210 recognizes no speaker's sound source (that is, when there is no command or when it is quiet), the processor 210 may move the first and second sound guides 131 and 132 at predetermined time intervals to thereby imitate an interaction with any speaker.

The movements 133 and 134 of the first and second sound guides 131 and 132 are not limited to these, and may be configured with predetermined directions or patterns that emerge naturally upon an interaction or communion with a user.

Because the head 112 is positioned between the first and second microphones 121 and 122 and the first and second sound guides 131 and 132 are positioned adjacent to the first and second microphones 121 and 122, a direction of a sound source may be extracted based on a machine learning technique, due to a difference between sound information arriving at the first and second microphones 121 and 122 according to the direction of the sound source, as described later.

Figure 4:
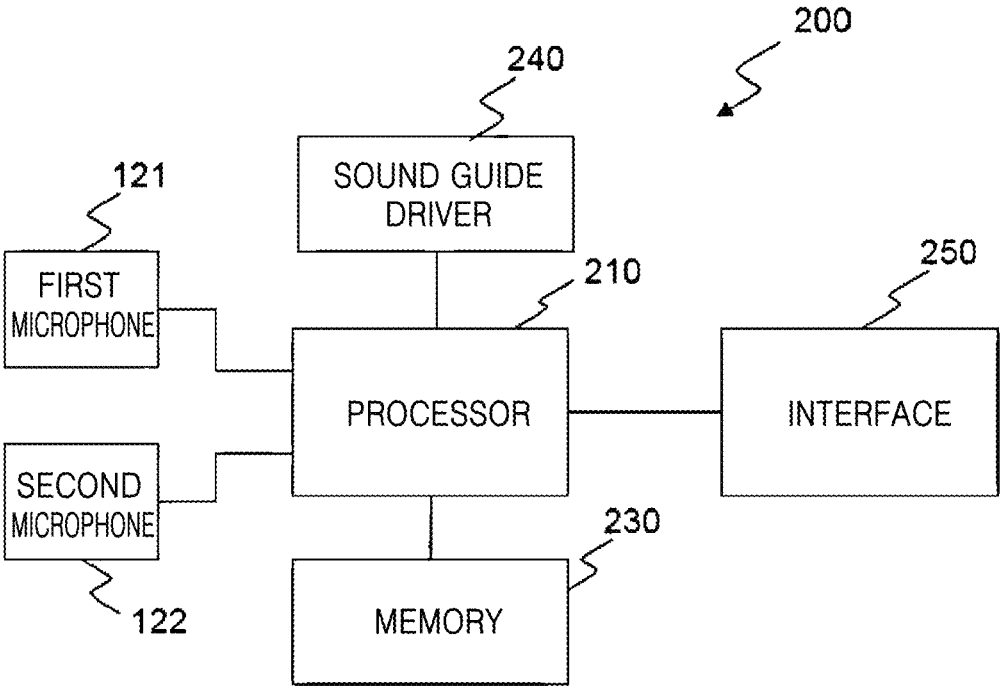
FIG. 4 is a block diagram schematically showing a circuit portion of the sound source separating apparatus of FIG. 1.

FIG. 4 is a block diagram schematically showing a circuit portion 200 of the sound source separating apparatus 100 of FIG. 1.

Referring to FIG. 4, the circuit portion 200 may include a processor 210, a memory 230, a sound guide driver 240, and an interface 250.

The processor 210 may control all operations of the sound source separating apparatus 100 including the first and second microphones 121 and 122, the memory 230, the sound guide driver 240, and the interface 250.

Also, the processor 210 may separate directions of sound sources based on a plurality of pieces of sound information received by the first and second microphones 121 and 122. The processor 210 may include one or more units. According to another example, information requiring a large amount of computations may be processed by a server connected through a network, and in this case, the processor 210 may be interpreted to include a part of the server connected through the network. Sound source separation operation of the processor 210 will be described later.

The memory 230 may include an internal memory, such as a volatile memory or a non-volatile memory. The memory 230 may store various data, programs, or applications that drive and control the sound source separating apparatus 100 under the control of the processor 210. The memory 230 may store signals or data that is input/output in correspondence to driving of the first and second microphones 121 and 122, the processor 210, the sound guide driver 240, and the interface 250 for inputs/outputs.

After the processor 210 separates a direction of a sound source, the sound guide driver 240 may drive the first sound guide driving motor 141 and the second sound guide driving motor (not shown) to move the first and second sound guides 131 and 132 based on the direction of the sound source. The interface 250 may be in charge of inputs/outputs between the sound source separating apparatus 100 and the outside. The interface 250 may include a wired or wireless communication module.

In the current embodiment, a case in which the first sound guide 131 is moved by the first sound guide driving motor 141 provided in the head 112 is described as an example. However, the current embodiment is not limited to this case.

Figure 5:
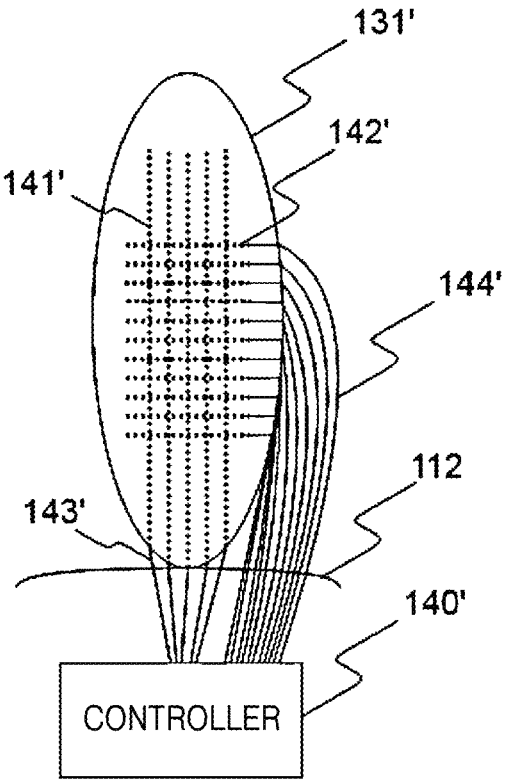
FIG. 5 schematically shows a driving structure of a first sound guide of a sound source separating apparatus according to another embodiment of the disclosure.

FIG. 5 schematically shows a driving structure of a first sound guide 131' of a sound source separating apparatus according to another embodiment of the disclosure.

Referring to FIG. 5, in the current embodiment, the first sound guide 131' may be made of a flexible material, such as rubber or silicon, and a driving device may be installed in the first sound guide 131' to provide a mechanical force to the first sound guide 131'. As the driving device for providing a mechanical force to the first sound guide 131', a piezoelectric body may be used. A plurality of first piezoelectric elements 141' may be formed in the shape of wires and arranged in a longitudinal direction of the first sound guide 131' having an ear shape. Likewise, a plurality of second piezoelectric elements 142' may also be formed in the shape of wires and arranged in a direction that is perpendicular to the longitudinal direction of the first sound guide 131' having the ear shape. The first and second piezoelectric elements 141' and 142' may be individually connected to a controller 140' or grouped to the controller 140'. Reference numerals 143' and 144' represent wires of the first and second piezoelectric elements 141' and 142'. When an appropriate voltage is applied to both terminals of the first and second piezoelectric elements 141' and 142', the first and second piezoelectric elements 141' and 142' may be bent, so that the first sound guide 131' may more naturally imitate a gesture of pricking up ears or a gesture of lowering a head.

The first and second piezoelectric elements 141' and 142' formed in the shape of wires are exemplary, and the shapes of the first and second piezoelectric elements 141' and 142' are not limited to wires. As another example, in a structure in which a wire (not shown) is positioned in the inside of the first sound guide 131' made of a flexible material and an end of the wire (not shown) is fixed at an end of the first sound guide 131', the first sound guide 131' may move when the wire is pulled or released from the outside (that is, the head 112). Also, it will be obvious to those skilled in the art that other well-known devices can be adopted for active movements of the first sound guide 131'. The second sound guide (132 of FIG. 1) may also include substantially the same driving device.

Figure 6:
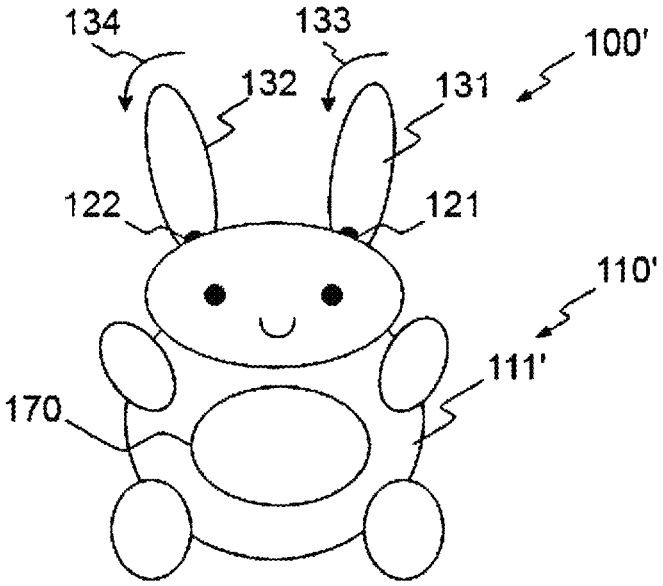
FIG. 6 schematically shows an outer appearance of a sound source separating apparatus according to another embodiment of the disclosure.

FIG. 6 schematically shows an outer appearance of a sound source separating apparatus 100' according to another embodiment of the disclosure.

The sound source separating apparatus 100' according to the current embodiment may be configured by adding an output device 170 to the sound source separating apparatus 100 described above with reference to FIGS. 1 to 5. The output device 170 may include at least one of, for example, a speaker or a display. For example, the output device 170 may be positioned on a front surface of a body 111' of a housing 110'.

The processor (210 of FIG. 4) may perform an operation of extracting a user's voice command from received sound information, or a function corresponding to a user's voice command. For example, the processor may reproduce music through the speaker or may display requested information on the display. The sound source separating apparatus 100' including the output device 170 may be, for example, an artificial intelligence speaker.

Figure 7:
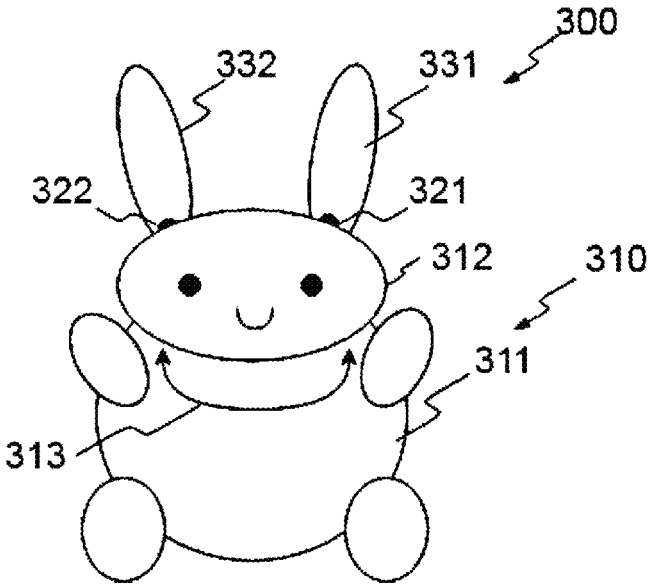
FIG. 7 schematically shows an outer appearance of a sound source separating apparatus according to still another embodiment of the disclosure.
Figure 8:
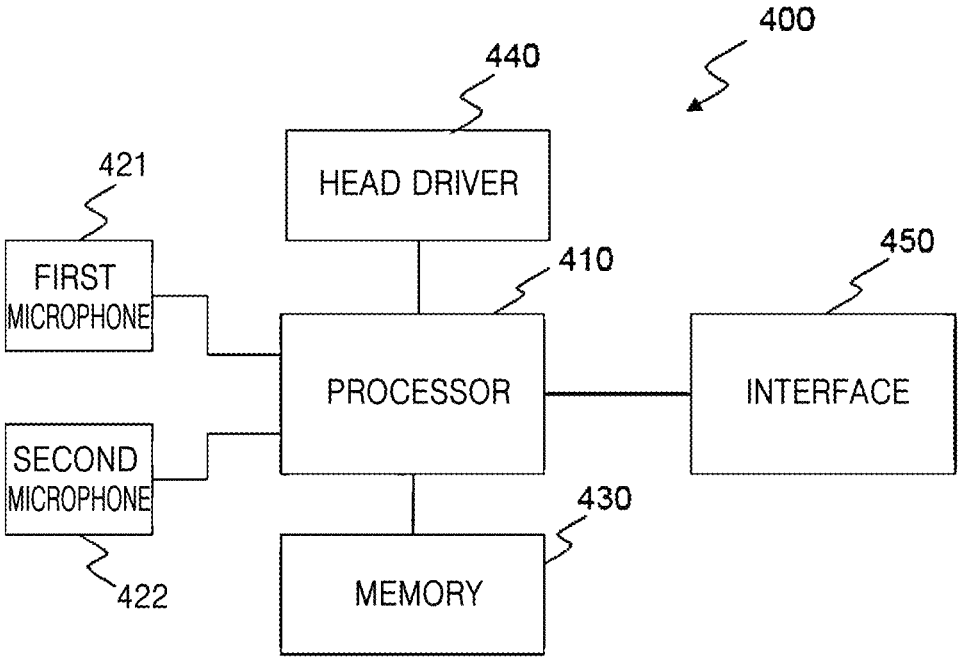
FIG. 8 is a block diagram schematically showing a circuit portion of the sound source separating apparatus of FIG. 7.

FIG. 7 schematically shows an outer appearance of a sound source separating apparatus 300 according to still another embodiment of the disclosure, and FIG. 8 is a block diagram schematically showing a circuit portion 400 of the sound source separating apparatus 300 of FIG. 7.

Referring to FIGS. 7 and 8, the sound source separating apparatus 300 may include a housing 310, first and second microphones 321 and 322, and first and second sound guides 331 and 332.

In the inside of the housing 310, the circuit portion 400 may be installed to control all operations of the sound source separating apparatus 300.

The housing 310 may include a body 311 and a head 312 positioned on the body 311. The first and second microphones 321 and 322 may be positioned at both sides of the head 312.

The first and second sound guides 331 and 332 may protrude from the head 312 at locations adjacent to the first and second microphones 321 and 322 and may be fixed at the head 312. The first and second sound guides 331 and 332 may be in the shape of bio-mimetic rabbit ears or in the shape of a flat plate or a concavely curved plate, as described above with reference to FIG. 3.

The head 312 may be movably coupled with the body 311. In the inside of the body 311 or the head 312, a head driving motor (not shown) for moving the head 312 may be provided.

Referring to FIG. 8, the circuit portion 400 may include a processor 410 for processing sound signals received by the first and second microphones 321 and 322, a memory 430, a head driver 440, and an interface 450. The circuit portion 400 of the current embodiment may be the substantially same as the circuit portion 200 described above with reference to FIG. 4, except that the head driver 440 is provided instead of the sound guide driver 440 of the circuit portion 200. Therefore, only the head driver 440 will be described.

After the processor 410 separates a direction of a sound source, the head driver 440 may drive a head driving motor based on the direction of the sound source.

A movement 313 of the head 312 may be, for example, a motion of rotating the head 312 in a left-right direction on a rotation axis which is a vertical direction, a motion of lowering or erecting the head 312, or a combination of the motions.

The head 312 may move to increase raw data required for sound source separation. For example, when the processor 410 separates a sound source according to its direction, probabilistic certainty for the result of the separation may not reach a predetermined reference value, as described later. In this case, the head driver 440 may move the head 312 to increase raw data required for the processor 410 to separate the sound source. A direction of the movement 313 of the head 312 may be decided randomly or as a direction of a sound source having highest probability in the result of sound source separation.

According to another example, when an already learned speaker's voice is separated upon sound source separation, the sound source separating apparatus 300 may move the head 312 such that a front surface of the head 312 is towards the speaker (sound source) to imitate an interaction with the speaker.

According to still another example, when the processor 410 separates a plurality of already learned speakers' voices upon separation of sound sources according to their directions, the sound source separating apparatus 300 may move the head 312 towards the speakers (sound sources) according to a predetermined rating method. When the sound source separating apparatus 300 or an electronic apparatus communicating with the sound source separating apparatus 300 operates according to a speaker's voice command, the sound source separating apparatus 300 or the electronic apparatus may analyze a plurality of rated speakers' voice commands in order to determine whether a meaningful voice command is received, and move the head 312 such that the front surface of the head 312 is towards a speaker with a top priority among speakers who have issued meaningful voice commands.

According to another example, in the case that the sound source separating apparatus 300 or the electronic apparatus communicating with the sound source separating apparatus 300 fails to understand content of a sound source when the processor 410 separates the sound source according to its direction, the sound source separating apparatus 300 may move the head 312 to imitate a gesture or body language representing that the sound source separating apparatus 300 cannot understand what the sound source means.

According to another example, when the processor 410 recognizes no speaker's sound source (that is, when there is no command or when it is quiet), the processor 410 may move the head 312 at predetermined time intervals to thereby imitate an interaction with any speaker.

The movement 313 of the head 312 is not limited to these, and may be configured with predetermined directions or patterns that emerge naturally upon an interaction or communion with a user.

Figure 9:
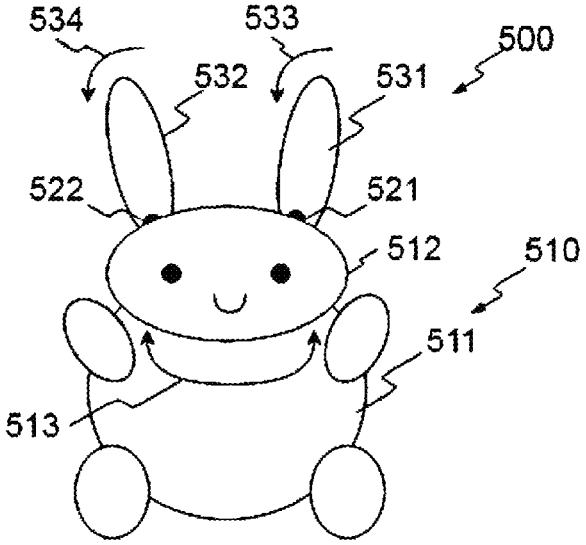
FIG. 9 schematically shows an outer appearance of a sound source separating apparatus according to another embodiment of the disclosure.

FIG. 9 is a block diagram schematically showing an outer appearance of a sound source separating apparatus 500 according to another embodiment of the disclosure.

Referring to FIG. 9, the sound source separating apparatus 500 according to the current embodiment may include a housing 510, first and second microphones 521 and 522, and first and second sound guides 531 and 532. In the inside of the housing 510, a circuit portion (not shown) may be installed to control all operations of the sound source separating apparatus 500.

The housing 510 may include a body 511 and a head 512 positioned on the body 511. The first and second microphones 521 and 522 may be positioned at both sides of the head 512. The first and second sound guides 531 and 532 may be positioned on the head 512 at locations adjacent to the first and second microphones 521 and 522.

The head 512 may be movably coupled with the body 511. The first and second sound guides 531 and 532 may be movably coupled with the head 512.

A movement 513 of the head 512 or movements 533 and 534 of the first and second sound guides 531 and 532 may be substantially the same as those described in the embodiment described above with reference to FIGS. 1 to 8, and accordingly, repeated descriptions will be omitted.

Hereinafter, sound source separation of the processor (210 of FIG. 4 or 410 of FIG. 8) will be described in more detail with reference to FIGS. 10 to 12.

Figure 10:
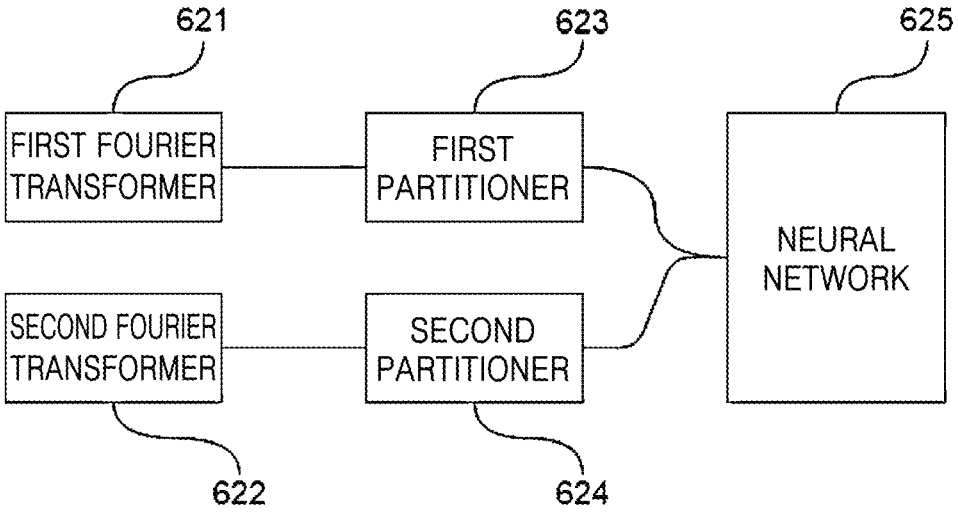
FIG. 10 is a block diagram of a processor according to an embodiment of the disclosure.

FIG. 10 is a block diagram of a processor according to an embodiment of the disclosure.

Referring to FIG. 10, a processor according to an embodiment may include a first Fourier transformer 621, a second Fourier transformer 622, a first partitioner 623, a second partitioner 624, and a neural network 625.

A first sound signal (information) acquired by the first microphone (for example, 121 of FIG. 1) may be transferred to the first Fourier transformer 621 through a first channel, and the first Fourier transformer 621 may perform a Fourier transform on the first sound signal (information) to generate intensity data according to frequency over time. Likewise, a second sound signal (information) acquired by the second microphone (for example, 122 of FIG. 1) may be transferred to the second Fourier transformer 622 through a second channel, and the second Fourier transformer 622 may perform a Fourier transform on the second sound signal (information) to generate intensity data according to frequency over time. The intensity data according to frequency over time, obtained by performing a Fourier transform on the first or second sound signal, is referred to as a spectrogram. In the current specification, a spectrogram is obtained by using a Fourier transform as a method of processing sound signals, however, Mel-Frequency Cepstral Coefficients (MFCC) or Cross Recurrence Plot (CRP) may be used instead of the spectrogram. The MFCC is a method of changing a power spectrum of sound to a log scale to express the power spectrum of sound nonlinearly, and the CRP is a matrix visualization method, wherein each element represents a distance in phase space of an audio sample. The spectrogram, MFCC, and CRP are well-known methods for representing sounds.

The first sound signal (information) transformed by the first Fourier transformer 621 may be transferred to the first partitioner 623, and the first partitioner 623 may partition the Fourier-transformed first sound signal (information) (1) at regular frequency intervals, (2) at regular time intervals, or (3) at regular frequency intervals and regular time intervals. Likewise, the second sound signal (information) transformed by the second Fourier transformer 622 may be transferred to the second partitioner 624, and the second partitioner 624 may partition the Fourier-transformed second sound signal (information) (1) at regular frequency intervals, (2) at regular time intervals, or (3) at regular frequency intervals and regular time intervals.

Although the first and second Fourier transformers 621 and 622 and the first and second partitioners 623 and 624 of the processor have been described as separate modules for description of functions, the first and second Fourier transformers 621 and 622 and the first and second partitioners 623 and 624 may be implemented as a single signal processor.

The partitioned first and second sound signals (information) may be transferred to the neural network 625.

As an internal structure of the neural network 625, a convolutional neural network (CNN) may be used. The convolutional neural network may have one or more convolution layers, and may be configured with a learnable weight and a bias. An algorithm for classifying images in the convolutional neural network is well known. When the convolutional neural network is used, a method of imaging inputs may be important. Accordingly, the first and second sound signals may be imaged as graphs, and then the graphs may be used as inputs. Also, in view of efficiency, a difference between the first sound signal and the second sound signal may be first calculated to be imaged as a graph, and then, the graph may be used as an input of the neural network 625. The meaning of imaging a signal and using the image as an input of the neural network 625 means changing an image to a number information list (matrix) and inputting the number information list (matrix).

According to another example, a Boltzmann machine or a restricted Boltzmann machine (RBM) may be used as an internal structure of the neural network 625. Also, a deep belief neural network that uses the restricted Boltzmann machine as a component may be used as an internal structure of the neural network 625. The restricted Boltzmann machine is a model resulting from removing connections between some units from the Boltzmann machine. The Boltzmann machine or the restricted Boltzmann machine is an unsupervised learning neural network model, and includes an input neuron layer and a hidden neuron layer.

The neural network 625 may be learned to perform sound source separation, as described later.

Figure 11:
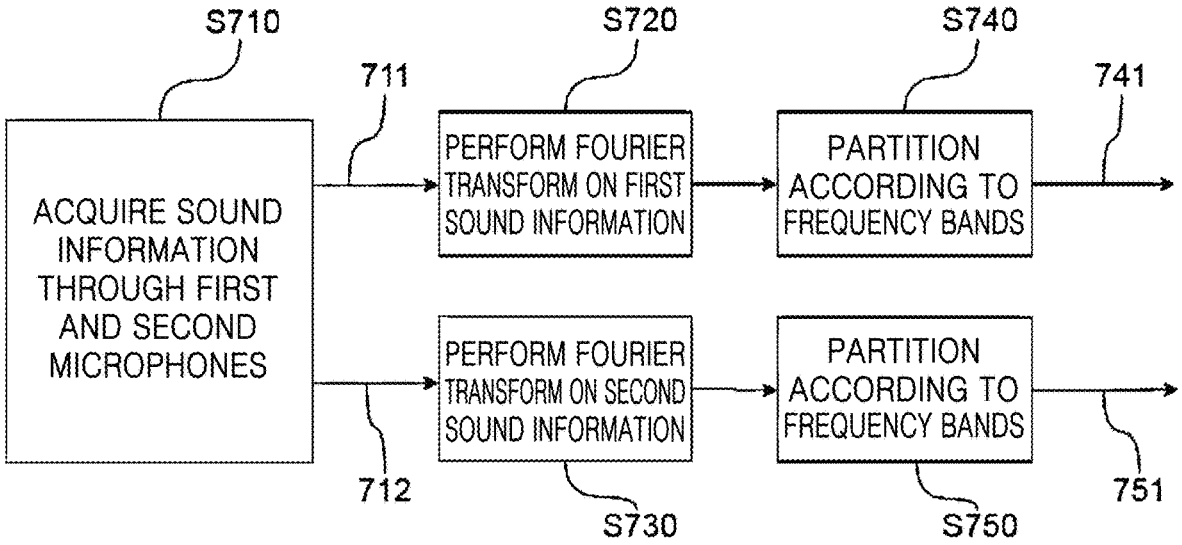
FIGS. 11 and 12 are diagrams illustrating a sound source separating method according to an embodiment of the disclosure.
Figure 12:
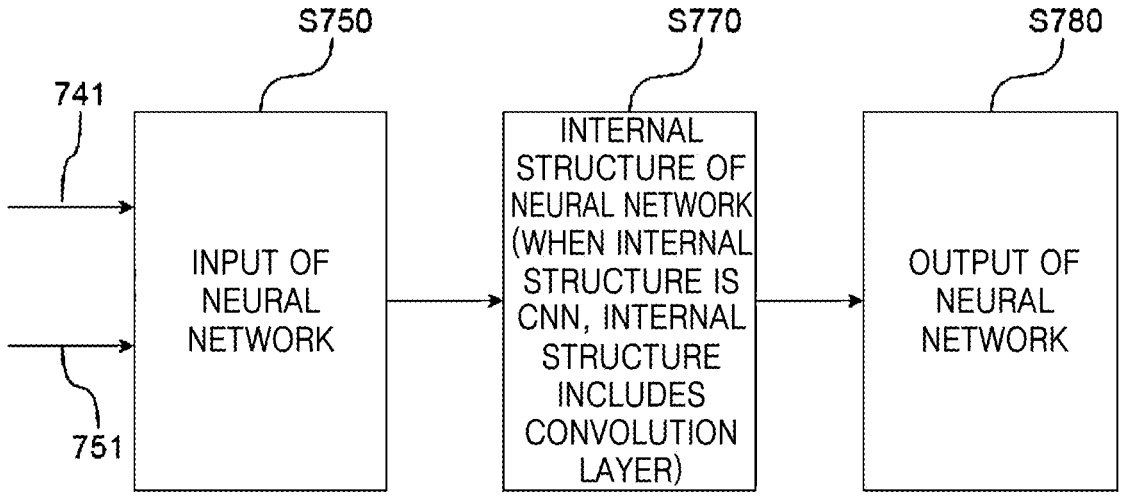

FIGS. 11 and 12 are diagrams illustrating a sound source separating method according to an embodiment of the disclosure.

Referring to FIG. 11, the sound source separating method according to the current embodiment may include operation S710 of acquiring first and second sound information 711 and 712 through the first and second microphones (for example, 121 and 122 of FIG. 1). The first and second sound information 711 and 712 may be intensity data lists of electronic signals over time. The intensity data lists of electronic signals over time may be represented as digitalized wave graphs.

The first and second sound information 711 and 712 may be transferred to the first and second Fourier transformers 621 and 622, respectively. By performing a Fourier transform on the first and second sound information 711 and 712, Fourier-transformed first and second sound information may be obtained in operations S720 and S730. The Fourier-transformed first and second sound information may be intensity data according to frequency over time.

Figure 13:
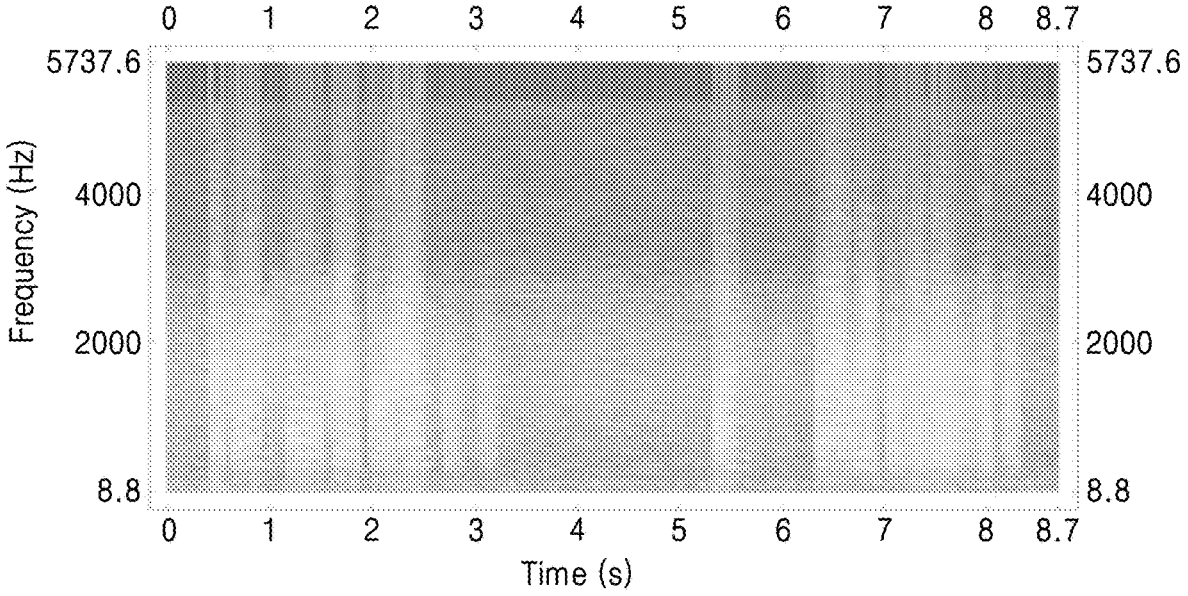
FIG. 13 shows a spectrogram representing intensity data according to frequency over time, according to an example.

FIG. 13 shows a spectrogram representing intensity data according to frequency over time, according to an example. Referring to FIG. 13, the horizontal axis of the spectrogram is an axis for time variables and the vertical axis of the spectrogram is an axis for frequency variables. According to another example, the spectrogram may represent differences in intensity as display colors, instead of printing density.

The first and second partitioners 623 and 624 may receive the Fourier-transformed first and second sound information, respectively, and partition the Fourier-transformed first and second sound information (1) at regular frequency intervals, (2) at regular time intervals, or (3) at regular frequency intervals and regular time intervals, in operations S740 and S750. As seen from the spectrogram shown in FIG. 13, it can be understood that the vertical axis (frequency axis) is partitioned by a predetermined frequency interval $\Delta f$, and/or the horizontal axis (time axis) is partitioned by a predetermined time interval $\Delta t$. The first and second sound information 741 and 742 partitioned by the first and second partitioners 623 and 624 may overlap. When numbers ranging from natural number 1 to natural number 100 are partitioned at intervals of 10 with an overlap size of 2, the numbers may be partitioned to 1-10, 8-17, 15-24, 22-31, . . . .

Referring to FIG. 12, the partitioned first and second sound information 741 and 742 may be transferred to the neural network 625, in operation S760.

The neural network 625 according to an embodiment may be a convolutional neural network, and in this case, an internal structure of the neural network 625 may include a convolution layer, in operation S770.

Directions of sound sources may be classified according to categories as follows.

- Four categories of front, rear, left, and right in a two-dimensional space
- Six categories of front, rear, left, right, up, and down in a three-dimensional space
- Categories resulting from dividing 360 degrees by a predetermined interval $\theta_0$ in a two-dimensional space
- Categories resulting from dividing $4\pi$ radian corresponding to a spherical surface area by a predetermined area in a three-dimensional space When $\theta_0$=10 degrees, a two-dimensional space may be divided to 36 categories.

Figure 14A:
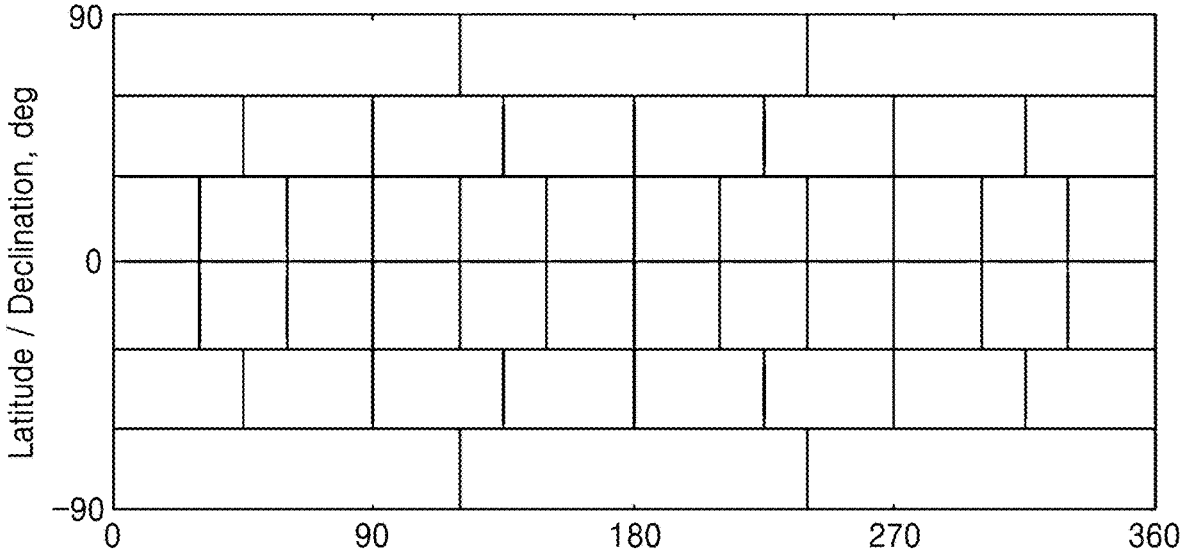
FIGS. 14A to 14C show examples of dividing $4\pi$ radian corresponding to a spherical surface area by a predetermined area in a three-dimensional space.
Figure 14B:
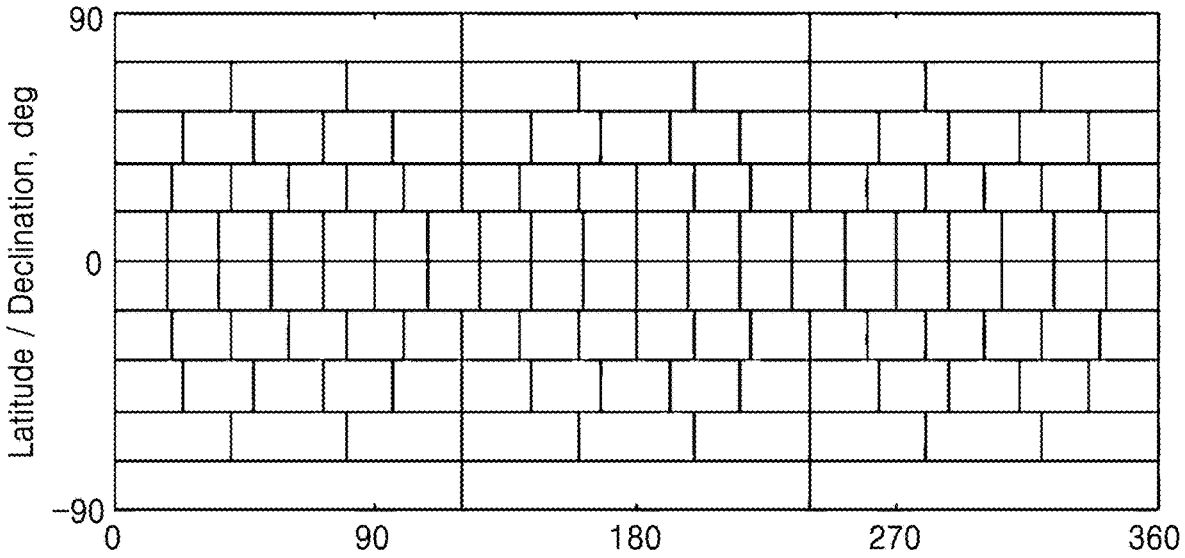
Figure 14C:
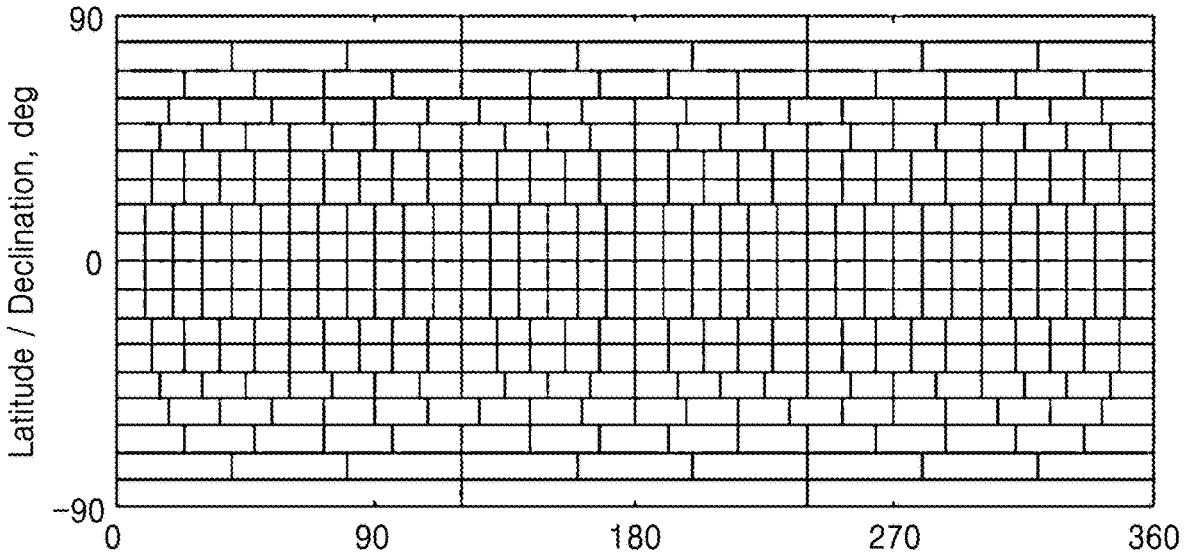

According to another example, a three-dimensional space may be divided as shown in FIGS. 14A to 14C (see Zinovy Malkin, a new method to subdivide a spherical surface into equal-area cells, arXiv:1612.03467).

The neural network 625 may be learned by supervised learning for informing sound information with a direction value (correct answer).

When the partitioned first and second sound information 741 and 742 is input to the neural network 625, a direction value may be output, in operation S780. When a plurality of sound sources are contained in a vertical band, a plurality of direction values will be output.

A case in which a sound source is divided to four categories of front, rear, left, and right according to a direction of the sound source is assumed. In this case, when front sound information is provided as an input after learning, outputs may be, for example, as follows.

Front: 0.9
Rear: 0.01
Left: 0.045
Right: 0.045

The outputs mean that there is a 90% probability that the sound source is located in a front direction.

When front and rear sound information are mixed and provided as inputs after learning, outputs may be, for example, as follows.

Front: 0.45
Rear: 0.50
Left: 0.026
Right: 0.024

The outputs mean that a probability that the sound source is located in the front direction is similar to a probability that the sound source is located in a rear direction. The case in which a plurality of sound directions are output may be a case in which there are a plurality of sound sources or a case in which a sound source fails to be classified to one direction. For example, when there are a plurality of sound sources, the sound sources may be learned individually to be classified. When a sound source learned as described above is recognized, operation of moving the first and second sound guides (for example, 131 and 132 of FIG. 1) or the head (for example, 312 of FIG. 7) towards the direction of the learned sound source may be performed.

The neural network 625 according to another embodiment may be a restricted Boltzmann machine. In this case, an internal structure of the neural network 625 may include visible units and hidden units, in operation S770. Alternatively, the neural network 625 may be a deep belief neural network that uses the restricted Boltzmann machine as a component.

According to an embodiment, sound information (preprocessed information, for example, Fourier-transformed, partitioned information) may be input to the visible units, and the hidden units may be set to categories of front, rear, left and right. According to the restricted Boltzmann machine, as learning progresses, a hidden unit corresponding to front may be activated (that is, a great value is output) when front sound information is input, and when rear sound information is input, a hidden unit corresponding to rear may be activated.

All sound sources have a pause period. For example, when a person speaks, he/she may make a pause for a moment without continuing to make a sound. However, there may be noise made continuously without any pause.

When a part of a sound source is in a pause period, the sound source has no data corresponding to the pause period on a vertical band of a spectrogram. When the data is input to an artificial intelligence, a direction value of the sound source corresponding to the pause period as an output may disappear (that is, the direction value disappeared is a direction value of the sound source in the pause period).

All vertical bands of the spectrogram may be input to the neural network 625 and output from the neural network 625.

According to an embodiment of the disclosure, operations S740 to S780 as described above may be repeated.

In a first circulation of operations S740 to S780, the horizontal axis (time axis) of a spectrogram may be divided by a predetermined time interval Δt to create a plurality of vertical bands, and each vertical band may be input to the neural network 625 so that the neural network 625 may output a first direction value. In a second circulation of S740 to S780, the vertical axis (frequency axis) of the spectrogram may be divided by a predetermined frequency band Δf to create a plurality of horizontal bands, and each horizontal band may be input to the neural network 625 so that the neural network 625 may output a second direction value. A direction value of an area at which the horizontal band intersects with the vertical band may be an intersection of the first and second output values of the neural network 625. The intersection may include a single element or a plurality of elements.

According to an embodiment of the disclosure, when an output value of the neural network 625, that is, the result of sound source separation does not reach a target value, a process of improving the result of sound source separation by applying a feedback loop for adjusting the predetermined partition interval and an overlap size may be performed. In other words, after at least one of Δt, Δf, or an overlap size is adjusted, operations S740 to S780 may be again performed. Alternatively, by increasing raw data required for the processor to perform sound source separation by moving the first and second sound guides (for example, 131 and 132 of FIG. 1) or the head (312 of FIG. 7), in addition to applying the feedback loop for adjusting the predetermined partition interval and the overlap size, the result of sound source separation may be improved.

When Δt, Δf, and the overlap size are adjusted, magnitudes of the partitioned first and second sound information may change, so that the newly partitioned first and second sound information may be unsuitable for the structure (a size of an input) of the neural network 625. In this case, the magnitudes of the newly partitioned first and second sound information may be adjusted to the original magnitudes, and then the adjusted first and second sound information may be input to the neural network 625. For example, when values of Δt and Δf are adjusted to smaller values, magnitudes of the partitioned first and second sound information may become smaller than the original magnitudes, and in this case, an operation of increasing the magnitudes of the partitioned first and second sound information may be performed so that the magnitudes of the partitioned first and second sound information are equal to the original magnitudes. For example, when a magnitude of an input of the neural network 625 is a 9*9 matrix and magnitudes of the newly partitioned first and second sound information are represented as a 7*7 matrix, 0 may be added as input values of edges of the newly partitioned first and second sound information, thereby increasing the magnitudes of the newly partitioned first and second sound information.

In some areas on the spectrogram, for example, an area having a first element as a single element may correspond to a sound of a first sound source, and an area having first and third elements may correspond to sounds of first and third sound sources.

Parts (single element areas) in which a sound source is separated may be removed, and then, operations S740 to S780 may be again performed.

Instead of the spectrogram, Mel-Frequency Cepstral Coefficients or Cross Recurrence Plot (CRP) may be used.

In the above description, a vertical or horizontal band of a spectrogram is input as an input unit to the neural network 625. However, a spectrogram may be divided in vertical and horizontal directions to form a checkerboard pattern, and each cell may be input as an input unit to the neural network 625. In other words, time and frequency bands of Fourier-transformed sound information may be partitioned at predetermined time intervals and at predetermined frequency intervals.

According to another embodiment, when input data including a plurality of sound sources is input to an artificial intelligence, a plurality of direction values may be output. For example, when a first direction and a second direction are output, parts of input data having a positive influence on the output of the first direction may be identified through a back-propagation algorithm. The parts may be collected to extract a sound source of the first direction.

According to another embodiment of the disclosure, when an output value of the neural network 625, that is, the result of sound source separation does not reach a target value, sound source separation operations S710 to S780 may be again performed after the first and second sound guides (for example, 131 and 132 of FIG. 1) or the head (for example, 312 of FIG. 7) moves. By moving the first and second sound guides (for example, 131 and 132 of FIG. 1) or the head (for example, 312 of FIG. 7), the characteristics of the first and second sound information may change so that data required for sound source separation becomes abundant, thereby improving a success rate of sound source separation.

The above-described embodiment relates to an example in which first sound information and second sound information are individually partitioned and then input to the neural network 625, as shown in FIG. 3. However, the disclosure is not limited to the example. That is, it will be obvious to one of ordinary skill in the art that when the number (that is, the number of channels) of sound information acquired by a sound receiving apparatus is three or more, the three or more sound information may be individually partitioned and then input to the neural network 625.

Figure 15:
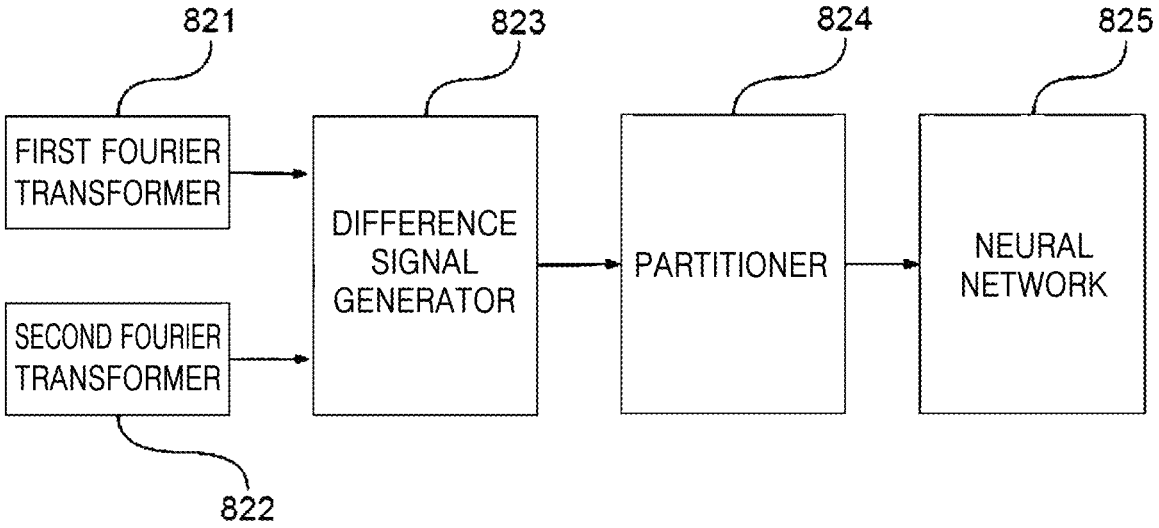
FIG. 15 is a block diagram of a processor according to another embodiment of the disclosure.
Figure 16:
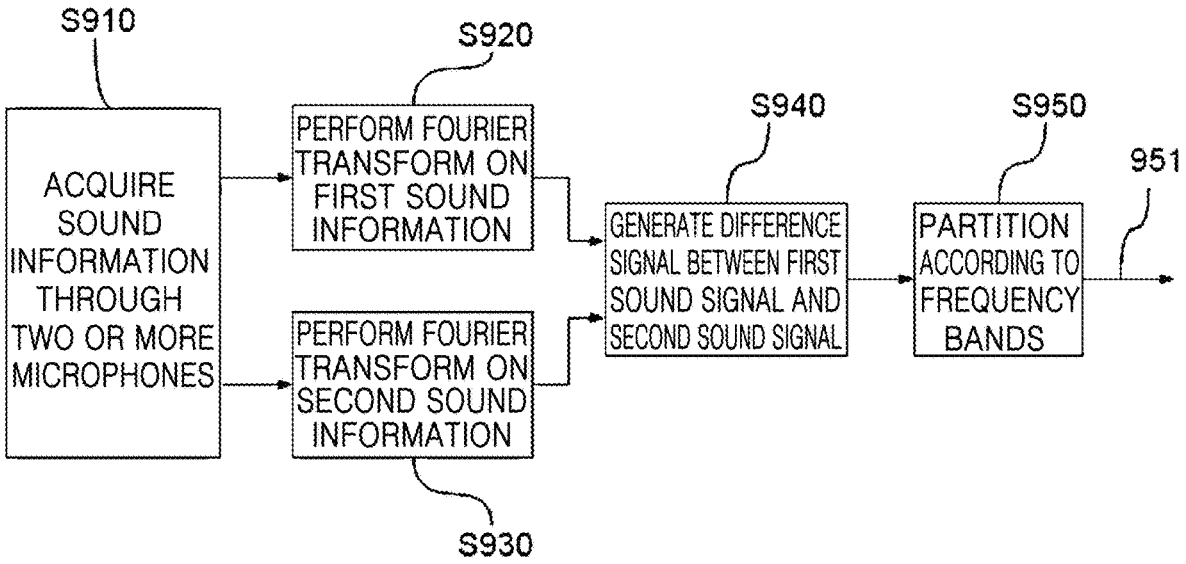
FIGS. 16 and 17 are diagrams illustrating a sound source separating method according to another embodiment of the disclosure.
Figure 17:
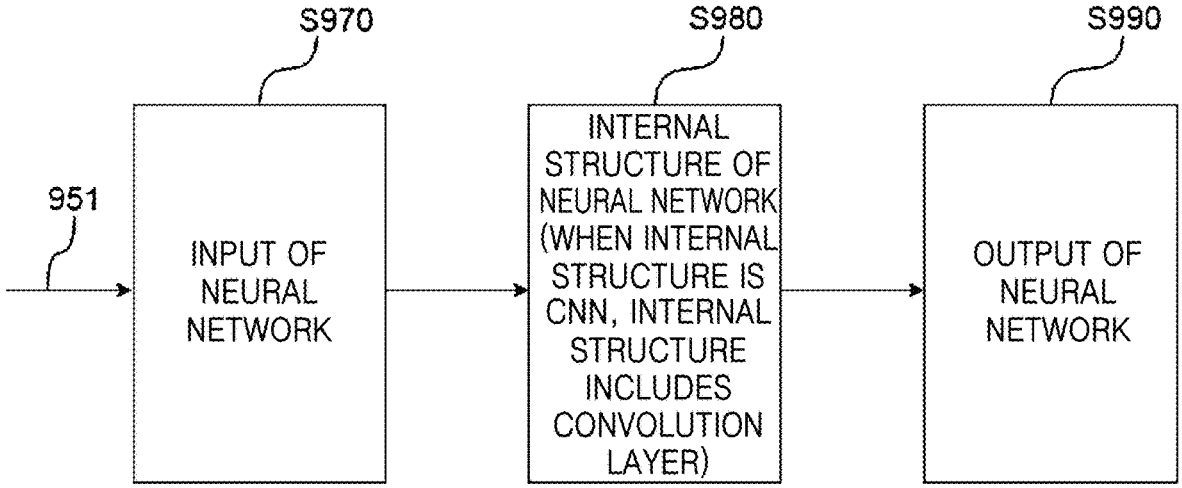

FIG. 15 is a block diagram of a processor according to another embodiment of the disclosure, and FIGS. 16 and 17 are diagrams illustrating a sound source separating method according to another embodiment of the disclosure.

Referring to FIGS. 15 to 17, a processor according to an embodiment may include a first Fourier transformer 821, a second Fourier transformer 822, a difference signal generator 823, a partitioner 824, and a neural network 825.

When first and second sound information is acquired through the first and second microphones (for example, 121 and 122 of FIG. 1) in operation S910, the first and second Fourier transformers 821 and 822 may generate intensity data according to frequency for the first sound information and the second sound information, respectively, in operations S920 and S930.

The difference signal generator 823 may receive the first sound information and the second sound signal to generate a difference signal, in operation S940. That is, the difference signal generator 823 may generate intensity difference data according to frequency, as a difference signal of the first sound information and the second sound information.

When the number (that is, the number of channels) of sound information acquired by a sound receiving apparatus is three or more, the difference signal may be acquired from pairs composed of arbitrary combinations of the sound information. The pairs of the sound information may be an arbitrarily selected pair or a plurality of arbitrarily selected pairs. When the number (that is, the number of channels) of sound information is three, three pairs of sound information may be made, so that a difference signal may be generated by arbitrarily selecting one of the three pairs or by selecting all of the three pairs. As described above, all or a part of operations shown in FIGS. 16 and 17 may be repeatedly performed for sound source separation, and when the operations are repeatedly performed, the combinations of pairs of sound information may change.

The partitioner 824 may partition the difference signal generated by the difference signal generator 823 to generate a partitioned difference signal 951, in operation S950. Since the difference signal input to the partitioner 824 can be represented as a spectrogram, the difference signal may be partitioned (1) at regular frequency intervals, (2) at regular time intervals, or (3) at regular frequency intervals and regular time intervals, similarly to the above-described embodiment. The partitioned difference signal 951 may be input to the neural network 825, in operation S970, and subject to an internal structure of the neural network 825 in operation S980 to be output from the neural network 825 in the state in which a sound source is separated, in operation S990. Since the partitioned difference signal 951 can also be represented as a spectrogram, MFCC, or CRP, the internal structure of the neural network 825 may be a convolutional neural network, a Boltzmann machine, a restricted Boltzmann machine, or a deep belief neural network, and sound source separation or learning performed by the neural network 825 may be substantially the same as the above-described example.

In the above-described embodiments, sound may include a human's voice, although not limited thereto.

The sound source separating apparatuses 100, 100', 300, and 500 of the above-described embodiments relate to an example in which two microphones are provided. However, three or more microphones may be provided. Also, the sound source separating apparatuses 100, 100',300, and 500 of the above-described embodiments relate to an example in which microphones are provided to one-to-one correspond to sound guides. However, a plurality of microphones may be positioned around a single sound guide.

The sound source separating apparatuses according to the embodiments can improve a sound source separation performance by providing the sound guides for the plurality of microphones.

The sound source separating apparatuses according to the embodiments can further improve a sound source separation performance by moving the sound guides in response to a direction of a separated sound source.

The sound source separating apparatuses according to the embodiments can improve a sound source separation performance by separating sound sources with the neural network.

As described above, the sound source separating apparatuses have been described with reference to the embodiments shown in the drawings, for easy understanding. However, the embodiments are only illustrative, and those skilled in the art will appreciate that various modifications and other equivalent embodiments are possible from the above embodiments. Accordingly, the true technical scope of the disclosure should be defined by the following claims.

What is claimed is:

1. A sound source separating apparatus comprising:

a housing;

a plurality of microphones positioned on the housing;

a plurality of sound guides positioned on the housing to be adjacent to the plurality of microphones, and configured to guide sound to the plurality of microphones and to generate a difference between a plurality of pieces of sound information respectively arriving at the plurality of microphones according to a direction of a sound source; and a processor configured to separate the sound source according to the direction of the sound source based on the plurality of pieces of sound information respectively arriving at the plurality of microphones, wherein at least one of the plurality of sound guides has a deformable structure or is movably coupled with the housing, and the sound source separating apparatus further comprises a sound guide driver configured to move the at least one of the plurality of sound guides in response to sound source separation by the processor.

2. The sound source separating apparatus of claim 1, wherein the housing comprises a body and a head positioned on the body, the plurality of microphones comprise a first microphone and a second microphone positioned at sides of the head, and the plurality of sound guides comprise a first sound guide and a second sound guide respectively protruding from the head at locations adjacent to the first microphone and the second microphone, the first sound guide and the second sound guide having a predetermined shape.

3. The sound source separating apparatus of claim 2, wherein the head is coupled with the body in such a way as to be movable with respect to the body, the sound source separating apparatus further comprising a head driver installed in at least one of the body or the head and configured to move the head in response to the sound source separation by the processor.

4. The sound source separating apparatus of claim 3, wherein, when probabilistic certainty for a result of the sound source separation by the processor does not reach a predetermined reference value upon separation of the sound source according to the direction of the sound source, the processor moves at least one of the first sound guide and the second sound guide or the head to increase raw data required for the processor to separate the sound source according to the direction of the sound source.

5. The sound source separating apparatus of claim 3, wherein, when the processor separates an already learned speaker's voice upon separation of the sound source according to the direction of the sound source, the processor moves at least one of the first sound guide and the second sound guide or the head towards the speaker.

6. The sound source separating apparatus of claim 3, wherein, when the processor separates a plurality of already learned speakers' voices upon separation of the sound source according to the direction of the sound source, the processor moves at least one of the first sound guide and the second sound guide or the head towards the speakers in order according to a predetermined rating method.

7. The sound source separating apparatus of claim 3, wherein, when the processor fails to understand content of the sound source, the processor moves at least one of the first sound guide and the second sound guide or the head.

8. The sound source separating apparatus of claim 1, wherein the first sound guide and the second sound guide are in a shape of bio-mimetic rabbit ears.

9. The sound source separating apparatus of claim 1, further comprising at least one of a speaker or a display.

10. A sound source separating apparatus comprising:

a body;

a head positioned on the body and coupled with the body in such a way as to be movable with respect to the body;

a first microphone and a second microphone respectively positioned at sides of the head;

a first sound guide and a second sound guide protruding from the head at locations adjacent to the first microphone and the second microphone, and configured to guide sound to the first microphone and the second microphone and to generate a difference between a plurality of pieces of sound information respectively arriving at the first microphone and the second microphone according to a direction of a sound source, the first sound guide and the second sound guide having a predetermined shape;

a processor configured to separate the sound source according to the direction of the sound source based on the plurality of pieces of sound information arriving at the first microphone and the second microphone; and a head driver configured to move the head in response to sound source separation by the processor, wherein the processor comprises:

a Fourier transformer configured to perform a Fourier transform on each of the plurality of pieces of sound information;

a partitioner configured to partition the plurality of Fourier-transformed pieces of sound information at predetermined intervals in at least one of a time domain or a frequency domain; and a neural network formed based on the plurality of partitioned Fourier-transformed pieces of sound information, and wherein the processor separates the direction of the sound source from the plurality of pieces of sound information based on output information output from the neural network.

11. The sound source separating apparatus of claim 10, wherein the partitioner partitions each of the plurality of Fourier-transformed pieces of sound information, and the plurality of partitioned Fourier-transformed pieces of sound information is input to the neural network.

12. The sound source separating apparatus of claim 10, further comprising a difference signal generator configured to generate a difference signal from at least one pair of signals configured with the plurality of Fourier-transformed pieces of sound information, wherein the partitioner partitions the difference signal, and the partitioned difference signal is input to the neural network.

13. The sound source separating apparatus of claim 10, wherein the partitioner partitions the plurality of Fourier-transformed pieces of sound information at predetermined time intervals in the time domain, the neural network receives the plurality of partitioned Fourier-transformed pieces of sound information in the time domain to output a first output value, the partitioner partitions the plurality of Fourier-transformed pieces of sound information at predetermined frequency intervals in the frequency domain, the neural network receives the plurality of partitioned Fourier-transformed pieces of sound information in the frequency domain to output a second output value, and the neural network separates the sound source by using an intersection of the first output value and the second output value.

14. The sound source separating apparatus of claim 10, wherein the partitioner partitions the plurality of Fourier-transformed pieces of sound information at predetermined time intervals in the time domain and at predetermined frequency intervals in the frequency domain, and the neural network receives the plurality of Fourier-transformed pieces of sound information partitioned in the time domain and the frequency domain.

15. The sound source separating apparatus of claim 10, wherein information of the plurality of partitioned Fourier-transformed pieces of sound information overlaps with a predetermined interval in at least one of the time domain or the frequency domain.

16. The sound source separating apparatus of claim 10, wherein the neural network includes a convolutional neural network, a Boltzmann machine, a restricted Boltzmann machine, or a deep belief neural network.

17. A sound source separating apparatus comprising:

a housing;

a plurality of microphones positioned on the housing;

a plurality of sound guides positioned on the housing to be adjacent to the plurality of microphones, and configured to guide sound to the plurality of microphones and configured to generate differences among a plurality of pieces of sound information respectively arriving at the plurality of microphones according to at least one of a direction, a distance, or a character of a sound source; and a processor configured to separate the sound source from another sound source according to the at least one of the direction, the distance, or the character of the sound source based on the differences among the plurality of pieces of sound information respectively arriving at the plurality of microphones via the plurality of sound guides;

wherein the plurality of sound guides comprises a first sound guide and a second sound guide, and a first sound guide driving motor and a second sound guide driving motor, the first sound guide driving motor and the second sound guide driving motor being configured to move the first sound guide and the second sound guide to increase data required by the processor to separate the sound source from the other sound source.

18. The sound source separating apparatus of claim 17, wherein the first sound guide driving motor and second sound guide driving motor are further configured to decide the at least one of the direction based on a probability associated with one of the sound source or the other source.

19. The sound source separating apparatus of claim 17, wherein the first sound guide driving motor and second sound guide driving motor are further configured to move the first sound guide and the second sound guide in a direction of an already-learned speaker's voice.

* * * * *